United States Patent [19]

Beaston

[11] 4,089,160

[45] May 16, 1978

[54] HORSESHOE BENDING APPARATUS AND VISE

[76] Inventor: Bud A. Beaston, Rte. 1, Box 13, Sperry, Okla. 74073

[21] Appl. No.: 769,859

[22] Filed: Feb. 18, 1977

[51] Int. Cl.[2] ..... B21K 15/02

[52] U.S. Cl. ..... 59/56

[58] Field of Search ..... 59/36, 38, 42, 44, 47, 59/48, 52, 54, 56, 60, 61; 72/388, 319, 310

[56] References Cited

U.S. PATENT DOCUMENTS

| | | | |
|---|---|---|---|
| 329,998 | 11/1885 | Bowen | 59/56 |
| 614,527 | 11/1898 | Allwood | 59/52 |
| 1,269,813 | 6/1918 | Hindley | 59/56 |
| 1,473,101 | 11/1923 | Hossfeld | 72/388 |
| 2,414,387 | 1/1947 | O'Neil | 72/388 |
| 3,400,532 | 9/1968 | Smith | 59/56 |

FOREIGN PATENT DOCUMENTS

| | | | |
|---|---|---|---|
| 487,850 | 7/1918 | France | 59/56 |
| 44,233 | 5/1917 | Sweden | 59/56 |
| 42,214 | 5/1908 | Switzerland | 59/56 |

*Primary Examiner*—C.W. Lanham
*Assistant Examiner*—Gene P. Crosby
*Attorney, Agent, or Firm*—Head, Johnson & Chafin

[57] ABSTRACT

A horseshoe bending apparatus having a multi-purpose forming plate whereby steel bar stock segments may be pulled around the outside edges of one side of the forming plate to form a rounded shoe conforming to the shape of a horse's front hoof. The stock may also be pulled around the opposite side of the forming plate to form an elliptical shaped shoe conforming to a horse's rear hoof. The apparatus includes clamping means used as a work vise for finishing out a horseshoe.

9 Claims, 10 Drawing Figures

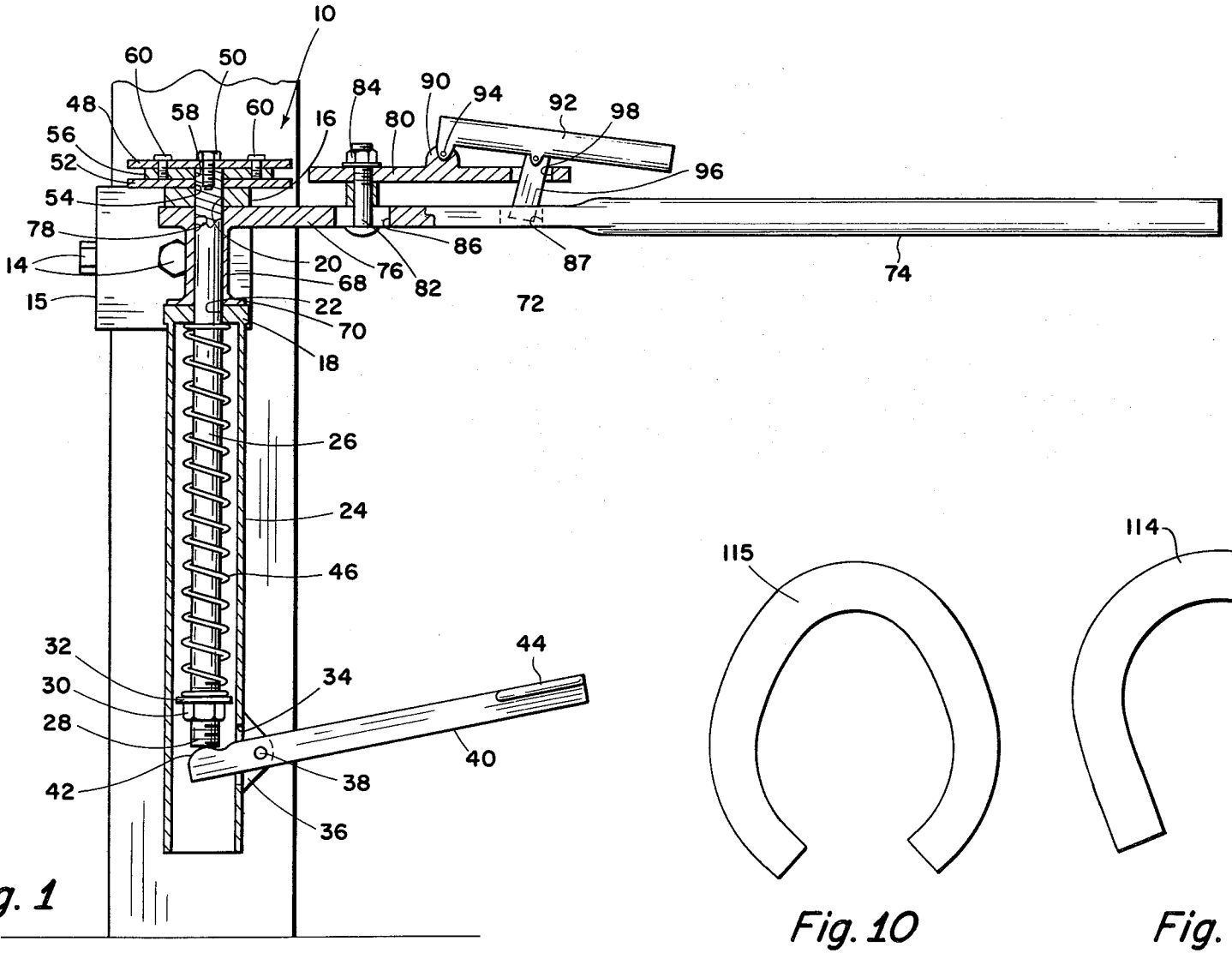
Fig. 1
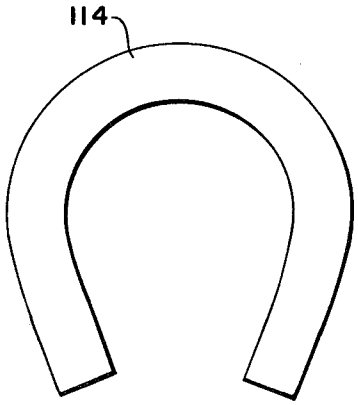
Fig. 9
Fig. 10

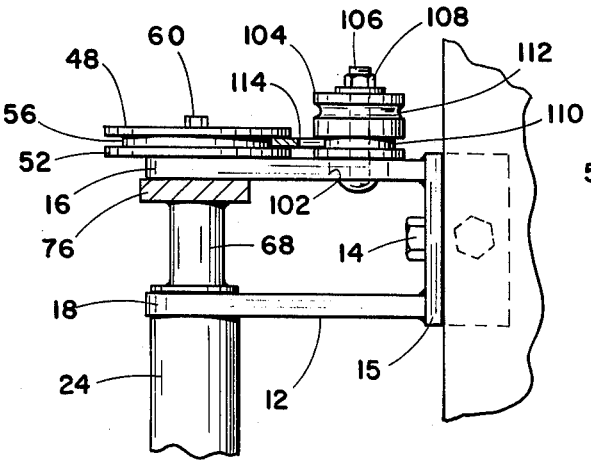
Fig. 4
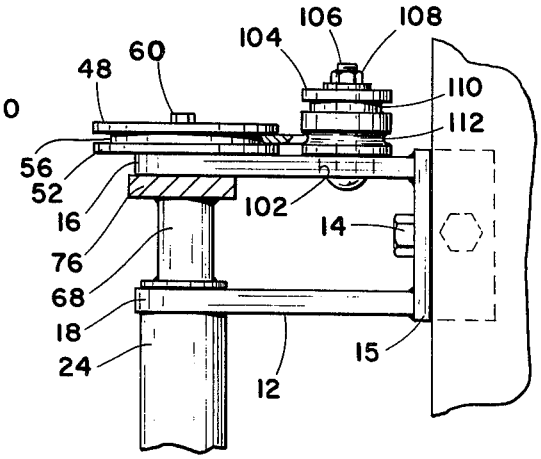
Fig. 5
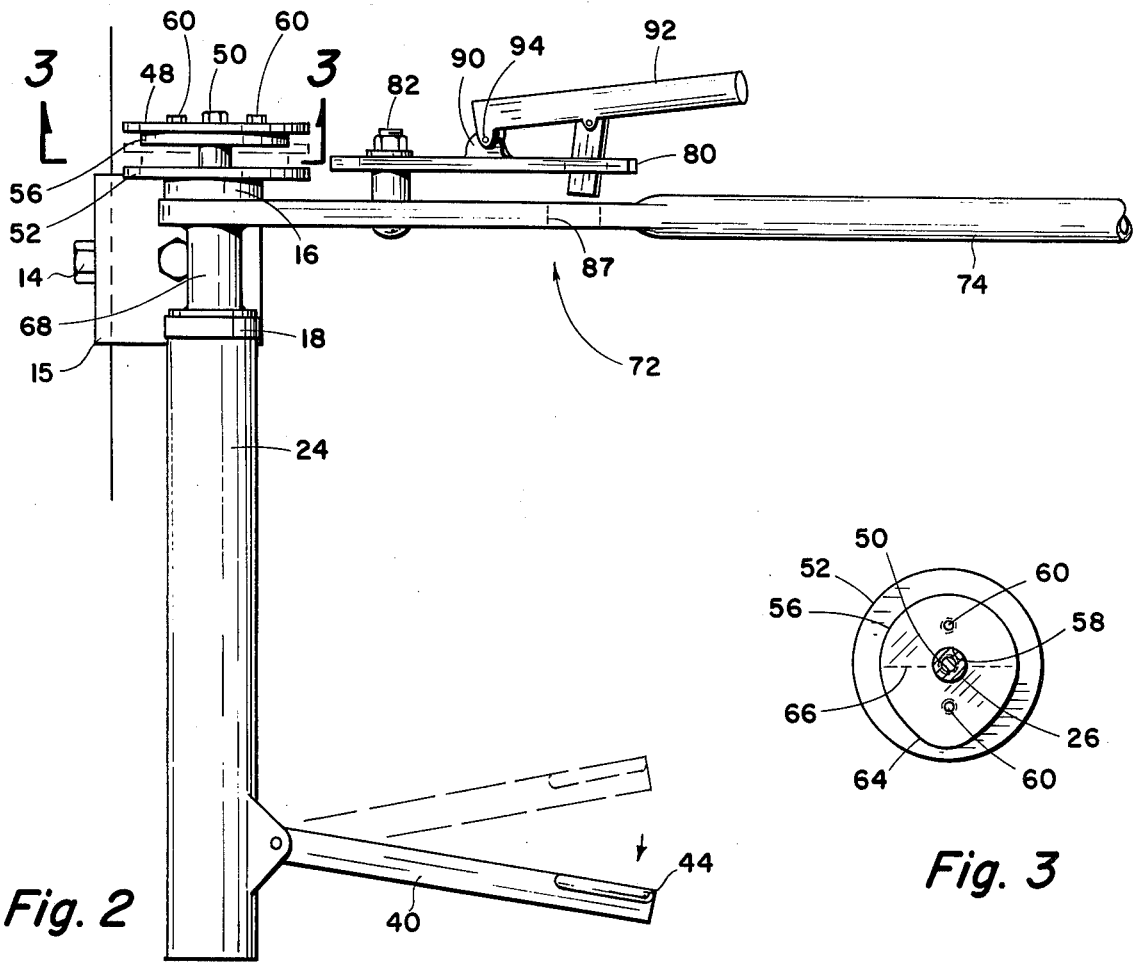
Fig. 2
Fig. 3

HORSESHOE BENDING APPARATUS AND VISE

BACKGROUND OF THE INVENTION

1. Field of the Invention

The present invention relates to a strip metal bending means, and more particularly, but not by way of limitation, to an apparatus for bending steel bar stock segments into the shape of horseshoes, the device also being usuable as a work vice.

2. Description of the Prior Art

The modern farrier's primary work, like those of ancient times, is to properly fit horses with shoes for various purposes, such as working, pleasure riding, racing and the like. However, the present farrier is faced with the problem of taking his work to the horse rather than the horse being brought to the blacksmith shop.

Therefore, it is important that he be able to carry with him, the necessary metal working tools in order to properly fit the horse's hoof, at the site.

Often the farrier is faced with normal metal shoes from strip bar stock to fit a special case shoeing job on the site away from the shop. This becomes an extremely difficult job when the shoe must be formed by the hammer and anvil method. However, if the shoe could be preformed at the site, then only minor modifications would be necessary with the hammer and anvil.

The previous shoe bending devices were extremely heavy duty, cumbersome, expensive and complicated in their use. The available prior art devices could feasibly be owned only by a large blacksmith shop.

SUMMARY OF THE INVENTION

A present invention provides a horseshoe bending apparatus which is particularly designed and constructed to overcome the above disadvantages and to provide a reasonably portable horseshoe bending apparatus which is capable of producing a quality horseshoe from steel strip bar stock segments.

The present device comprises a holding means which cooperates with a rotatable gripping device in order to form the desired shaped horseshoe. The device is equipped with a forming plate having one edge portion of a substantially circular configuration while the opposite edge is elliptical in shape so that the forming of one type of a shoe will be about the rounded surface which more or less conforms to the shape of a horse's front hoof. In order to create an elliptical shaped shoe which is suitable for a horse's rear hoof, the forming plate is simply started at a position 180° from the original position so that the shoe is bent around the elliptical surface of the forming plate.

In order to hold the bar stock in the correct position with respect to the forming plate, the apparatus includes a vise mechanism which is operated by the user's foot and after the horseshoe has been formed, the mechanism can be utilized as a vise for trimming the shoe to the correct shape and removing unwanted rough portions and burs therefrom. The closing force of the vise is by means of a helical compression spring that obviates the need for any threaded closure device.

The device is somewhat portable in that it may be quite easily attached to a farrier's vehicle or trailer for portability but may also be attached to a convenient wall or mounting post at the farrier's stop.

DESCRIPTION OF THE DRAWINGS

Other and further advantgeous features of the present invention will hereinafter more fully appear in connection with the detailed description of the drawings in which:

FIG. 1 is a partial sectional elevational view of a horseshoe bending apparatus and device embodying the present invention.

FIG. 2 is an elevational view of the device in FIG. 1 shown attached to a vertical surface.

FIG. 3 is a sectional bottom view of the forming plate taken along the broken line 3—3 of the FIG. 2.

FIG. 4 is an elevational view of the forming portion of the device and is shown with a piece of rectangular bar stock fitted therein.

FIG. 5 is the view of FIG. 4 depicting a piece of beveled bar stock fitted therein.

FIG. 9 is a plan view of a front horseshoe having been formed as shown in FIGS. 6, 7 and 8.

FIG. 10 is a plan view of a rear horseshoe which may be formed with the device.

DETAILED DESCRIPTION OF THE PREFERRED EMBODIMENT

Figure 6:
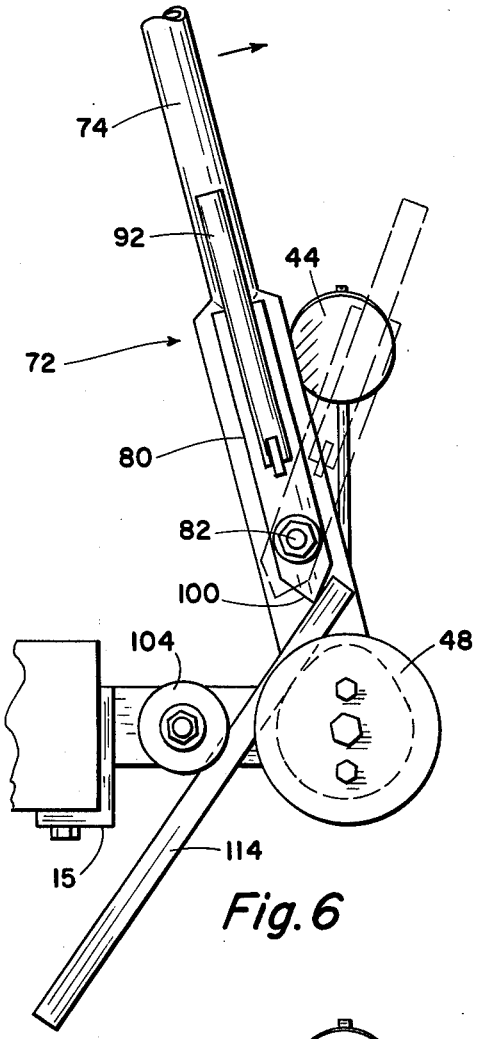
FIG. 6 is a top or plan view of the device shown in the position of beginning the formation of a horseshoe.

Referring to the drawings in detail, reference character 10 generally indicates a horseshoe bending apparatus which is carried by a U-shaped frame member or other simple bracket device available to a wall or other vertical structure by a plurality of bolts, screws or the like 14. The U-shaped frame 12 comprises a wall bracket 15, and a pair of outwardly extending vertically spaced leg members or plates 16 and 18 which are provided with aligned vertical bores 20 and 22, respectively, near the outer ends thereof.

An elongated hollow cylindrical sleeve member 24 is secured to the bottom of the lower plate 18 and in coaxial alignment with the centerline axis of the aligned bores 20 and 22. An elongated vertical rod 26 is reciprocally disposed within the vertical sleeve and extends upwardly through the aligned bores 20 and 22 and is rotatable with respect thereto. The lower end of the vertical rod 26 is threaded at 28 and is provided with a cooperating threaded nut 30 and a large washer member 32.

One side of the lower portion of the sleeve member 24 is provided with an aperture 34 therethrough. An outwardly extending bracket member or ear member 36 secured to the sleeve 24 adjacent the aperture 34. Pivotally mounted to the ear member 36 by means of a pivot pin 38 is an elongated foot operated lever arm 40. One end 42 of the lever arm 40 extends through the aperture 34 to the interior of the sleeve 24. The opposite end of the lever arm 40 is provided with a foot pad member 44. The upper portion of the end 42 of the lever arm 40 is engageable with the lower end of the vertical rod 26.

An elongated vertically disposed helical compression spring 46 is disposed around the rod 26 with the upper end thereof being in contact with the lower surface of the support leg 18 and the lower opposite end of the said compression spring 46 being positioned against the upper surface of the washer 32. The spring is installed in compression thereby tending to force the vertical rod 26 downwardly against the end 42 of the lever arm 40.

A first circular plate member 48 is centrally secured to the upper end of the vertical rod 26 by means of a bolt 50. A second similar circular plate 52 having a central bore 54 therethrough for receiving the vertical rod 26 therethrough, is loosely disposed on the upper surface of the support leg member 16.

A forming plate 56, which is configured substantially in an egg shape, which will be hereinafter more fully described, is provided with the central bore 58 for receiving the upper end of the rod 26 therethrough. The forming plate 56 is rigidly secured to the lower surface of the circular plate member 48 by a plurality of screws 60. One side of the outer edge of the forming plate 56 substantially forms a semi-circular shape as identified by reference character 62. The opposite side or edge of the forming plate 56 is elliptically shaped as identified by reference character 64. The shape of the plate can be best described by utilizing an imaginary dashed line identified by reference character 66 and depicted in FIG. 3, where the dashed line 66 represents the minor axis of the elliptical shape 64 and represents the diameter chord of this semi-circular shape 62, with the aperture 58 therethrough lying on the imaginary line 66.

A short collar 68 is journalled on the rod 26 between the support leg members 16 and 18. The lower end of the collar 68 is provided with a flange 70, the lower surface thereof acting as a bushing between the collar 68 and the upper surface of the lower support leg member 18. An elongated horizontally disposed lever bar generally indicated by reference character 72 has an elongated handle member 74 at one end thereof, the opposite end thereof being shaped as a flat plate member 76 and having a bore 78 near one end thereof for receiving the elongated rod 26 therethrough. The lower surface of the plate member 76 is rigidly attached to the upper end of the collar 68 by any suitable means such as welding.

An elongated bar stock engagement device 80 is pivotally attached to the lever arm plate 76 by means of a bolt 82 and cooperating nut 84, the bolt 82 being passed through a longitudinal slot 86 provided in the lever arm plate 76. Spaced between the slot 86 and the handle member 74 is a second longitudinal slot 86 for a purpose that will be hereinafter set forth. The elongated plate 80 is spaced from plate 76 by means of a collar 88 surrounding the bolt 82. The plate 80 is placed in such a manner that it is opposite the forming plate 56 and in the plane thereof when the plate 56 is in the lowered position shown in FIG. 1.

The plate member 80 is provided with an upwardly extending ear member 90 for pivotally carrying a handle member 92 by means of the pin 94. The handle member 92 is also provided with a bar 96 pivotally attached to the lower surface thereof and extends downwardly through an aperture 98 provided in the free end of the plate member 80. The end of the plate member 80 opposite the aperture 98 is tapered to a point 100 for a purpose that will be hereinafter set forth.

The aperture 98 in the plate 80 and the aperture 87 in the plate 76 are sized and positioned so that when the handle member 92 is rotated into alignment with the lever arm 72, the downwardly extending rod 96 will fit through both the aperture 98 and the slot 87 regardless of the position of the bolt 82 and the slot 86. Naturally by enlarging the slot 87 and the plate 76, it will be unnecessary that the bar 96 be pivotally mounted but could be rigidly secured to the lower surface of the handle member 92.

Referring now to FIGS. 4 and 5, the upper support leg 16 is provided with a slot aperture 102 therethrough located between the circular plate member 52 and the wall bracket 12. A bar stock stop member 104 hereinafter referred to as a cylindrical member, is rotatably attached by a bolt 106 and cooperating nut 108, the bolt 106 passing through the slot aperture 102. The outer surface of the cylindrical member 104 is provided with two parallel grooves therearound. The first groove 110 is rectangular in cross-sectional shape and the second groove 112 is of a beveled cross-sectional shape for purposes that will be hereinafter set forth. It is noted in FIG. 4 that the rectangular groove 110 is positioned below the aperture 112 so that the rectangular groove 110 is directly opposite the forming plate 56 in the lowered position shown. On the other hand, FIG. 5 depicts the sleeve member 104 inverted such that the beveled groove 112 is opposite the forming plate 56 as shown. It will be later noted in the description of the operation of the mechanism that it is not absolutely necessary that the cylindrical member 104 be rotatable however, by allowing it to be rotatable, the grooves experience even wearing during the operation or life thereof.

Referring now to FIGS. 1 and 2, it is noted that when the foot pedal 44 is depressed, the lever arm 40 tends to raise the rod 26 against the force of the compression spring 46. This in turn lifts the circular plate 48 and its attached forming plate 56 away from the circular plate 52. By use of this foot pedal, the device may be utilized as a vise with the gripping surfaces being the lower surface of the forming plate 56 and the upper surface of the circular plate 52.

In order to describe the method of forming a horseshoe from ordinary bar stock, reference is made to FIGS. 2 through 8. First assuming that bar stock is rectangular in cross-section, the cylindrical member 104 is positioned as shown in FIG. 4, with the rectangular groove being opposite the forming plate 56.

After the cylindrical member 104 has been oriented as shown in FIG. 4, its distance from the forming plate 56 is adjusted within the slot 102 in the manner that will be hereinafter set forth. The foot pedal 44 is then depressed thereby raising the circular plate 48 and attached forming plate 56 as shown in FIG. 2. The handle member 92 is then lifted thereby raising the vertical bar 96 out of engagement with the slot or aperture 87 and the flat bar member 80 is then rotated clockwise as shown in FIG. 6 to a position generally indicated by dashed lines. The circular plate 48 and the attached forming plate 56 are then rotated to a position as shown in FIG. 6 which is dependent upon the position of the cylindrical member 104 again in a manner that will be hereinafter set forth.

An elongated bar stock segment 114 of rectangular cross-section is then inserted in the mechanism as is shown with one edge thereof resting within the rectangular groove 110 of the cylindrical member 104 and the opposite side thereof being tangent to the outer edge of the forming plate 56. The foot pedal 44 is then released allowing the circular plate 48 and attached forming plate to be pulled downward in contact with the bar stock segment as shown in FIG. 4.

The flat plate member 80 is then rotated back into alignment with the lever arm 72 so that the point 100 of the flat plate 80 is in contact with one edge of the bar stock segment as shown in FIG. 6. The handle member 92 is then lowered thereby allowing the vertical bar 96 to enter the aperture 87 which locks the plate member 80 in the position shown in FIG. 6.

The handle 7A of the lever arm 72 is then slowly rotated in a clockwise direction as shown in FIG. 6 thereby pulling the bar stock segment around the forming plate 56 as shown in FIG. 2. It is noted that due to the gripping pressure applied between the circular plates 48 and 52 and the pressure on the end of the bar stock segment exerted by the point 100, the circular plates 48 and 52 and the attached forming plate 56 all rotate in a clockwise direction as the bar stock segment 114 is pulled therearound.

At the same time, the cylindrical member 104 is rotating in a counterclockwise direction allowing one edge of the bar stock segment to travel through the rectangular groove 110 thereof.

Figure 8:
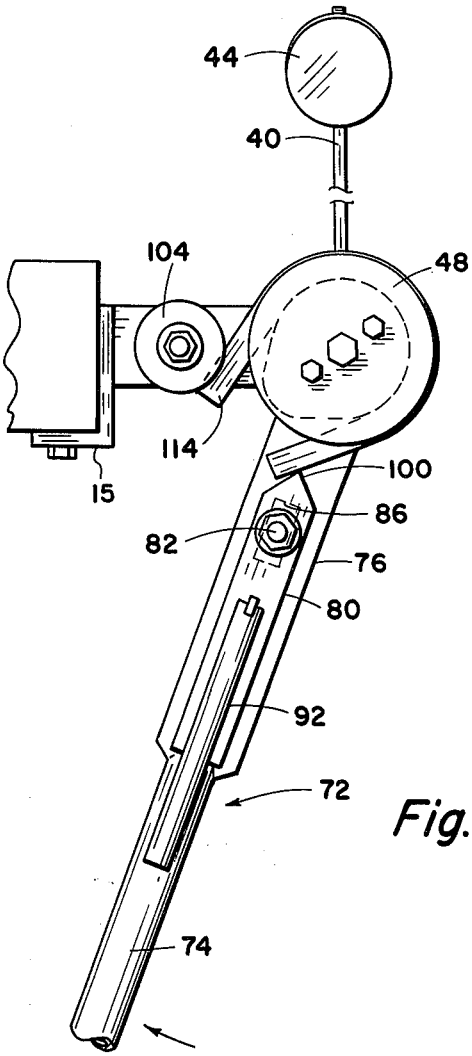
FIG. 8 is the plan view of a horseshoe having been completely formed.
Figure 7:
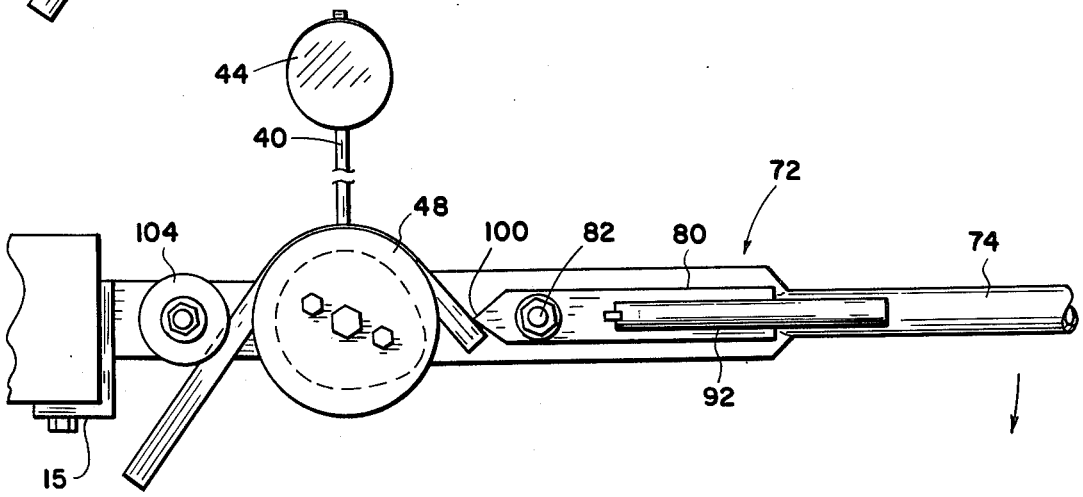
FIG. 7 is the plan view of the horseshoe partially formed.

When the lever arm 72 is rotated to the position shown in FIG. 8, the shoe is completed and rotation of the lever arm is halted at that point. The handle member 92 is then raised and the plate 80 is then rotated again clockwise so that the point 100 thereof is removed from contact with the edge of a horseshoe. The foot pedal 44 is again depressed thereby releasing the horseshoe so that it may be removed from the forming device. After this time if there are any burs or modifications that need to be made to the formed horseshoe, the vise mechanism as hereinbefore described may be utilized to hold the horseshoe while it is being trimmed by a rasp or other appropriate tool (not shown).

Since the horseshoe that has been formed and was rotated around the semi-circular edge 62 of the forming plate 56, the configuration of the horseshoe is as shown in FIG. 9. This rounded configuration is suitable for a horse's front hoof.

If it is desired to form a horseshoe the configuration of a horse's rear hoof which is somewhat elliptical in shape, the same steps are utilized. However, when orienting the forming plate as shown in FIG. 6 the plate will be turned 180° from that shown.

If it is desirable to have the ends of the formed horseshoe closer together as shown in the drawings, the cylindrical member 104 is adjusted within the slot 102 closer to the forming plate 56. This closeness is naturally limited by the width of the bar stock being utilized to form the horseshoe. When the cylindrical member 104 is pulled closer to the forming plate 56, the forming plate would have to be oriented slightly counterclockwise from the position shown in FIG. 6 so the shoe comes out of the form symmetric.

On the other hand, if it is desired to have an open configuration for the ends of the horseshoe from that shown in FIGS. 9 or 10, then the cylindrical member 104 is moved outwardly away from the forming plate 56 and the forming plate is oriented at a position slightly clockwise from the position shown in FIG. 6.

While the inventor has no exact formula for relative positions for the forming plate and the cylindrical member 104, it has been found that after a few minutes practice by one skilled in the art, he can adjust the device to form a symmetric shoe.

If it is desirable to form a shoe 115 from a rounded or beveled bar stock, the cylindrical member 104 is removed and inverted as shown in FIG. 5 so that the beveled groove 112 is in alignment with the forming plate 56.

It is also noted for various sized horseshoes where the sizes are significantly different, different sized forming plates 56 may be simply attached to the circular plate 52.

From the foregoing it is apparent that the present invention provides a horseshoe bending apparatus for forming a variety of sizes and shaped horseshoes to fit an individual need, while at the same time providing a very useful and handy vise for trimming and finishing the final horseshoe.

Whereas, the present invention has been described in particular relation to the drawings attached hereto, other and further modifications apart from those shown or suggested herein may be made within the spirit and scope of the invention.

I claim:

1. A horsehoe bending apparatus for forming horseshoes from strip bar stock and comprising:

(a) stationary frame means;

(b) form support means pivotally carried by the frame means, a forming plate carried on the support means and having a portion of the outer edge thereof in the shape of the inner periphery of the desired horseshoe, a pair of oppositely disposed guide plates carried by the support means on opposite sides of the forming plate for providing a channel around the outer edge of said forming plate for receiving bar stock therein;

(c) a bending stop member secured to the frame means and spaced from the forming plate, said stop member having a groove therein in a plane parallel to that of the forming plate;

(d) bar stock engaging means carried by the form support means for selective engagement with one end of the bar stock;

(e) means for rotating the engaging means with respect to the stationary frame means in a plane parallel to that of the forming plate;

whereby upon rotation of the engaging means, the bar stock segment is pulled through the bending stop member groove and is bent around said shaped portion of the forming plate outer edge to form a horseshoe.

2. The bending apparatus as set forth in claim 1 wherein the bar stock engaging means also comprises an elongated lever arm having a handle portion at the outer end thereof, the inner end of said lever arm being pivotally attached to the form support means, an elongated engagement tool pivotally carried by the lever arm and having a sharpened point for selective engagement with the strip bar stock, and locking means carried by the engaging means for selectively locking said engagement tool in engagement with said strip bar stock.

3. A bending apparatus as set forth in claim 1 wherein the forming plate has a first edge portion shaped substantially semicircular and the opposite edge portion shaped substantially in a half-elipse, the minor axis of the half-elipse coinciding with and common with the semi-circular portion cord.

4. The bending apparatus as set forth in claim 1 wherein the stationary frame comprises an elongated housing having means for attaching said housing to a stationary structure.

5. The bending apparatus as set forth in claim 4 wherein the form support means comprises an elongated rod rotatably and reciprocally disposed within said housing and having the outer end thereof extending out of said housing, the forming plate and guide plates being disposed on the outer end portion of the rod, the planes of said plates being perpendicular to the axis of the rod.

6. The bending apparatus as set forth in claim 5 wherein the outer most guide plate and forming plate are secured to the outer end of the rod for movement therewith and the inner guide plate is provided with a central bore therethrough for slidably receiving the rod therethrough.

7. The bending apparatus as set forth in claim 6 wherein an elongated helical compression spring is disposed around the outer periphery of the rod, one end of said spring being an engagement with the stationary frame, the opposite end thereof being attached to the inner end of the rod to yieldably force the rod in a direction interior of the housing, the outermost guide plate and attached forming plate being yieldably forced toward the inner guide plate.

8. The bending apparatus as set forth in claim 7 and including a vise operator means carried by the elongated housing and engageable with the elongated rod for selective longitudinal movement of said rod against the force of said helical spring.

9. The bending apparatus as set forth in claim 8 wherein the vise operator means comprises an aperature in said housing, an elongated foot pedal means pivotally attached to the housing adjacent said aperture, one end of said pedal means being engaged with the inner end of the elongated rod within the housing, the outer end thereof extending outwardly from said housing, whereby pressure exerted on the outer end of said pedal means moves the rod longitudinally against the force of the helical compression spring.

* * * * *